US011732431B2

(12) United States Patent
Schmid, Jr.

(10) Patent No.: US 11,732,431 B2
(45) Date of Patent: Aug. 22, 2023

(54) SUBMERGIBLE WATER ACTIVITY PLATFORM SYSTEM

(71) Applicant: JSV Group, Inc., Seneca, SC (US)

(72) Inventor: Jerome R. Schmid, Jr., Seneca, SC (US)

(73) Assignee: JSV Group, Inc., Seneca, SC (US)

( * ) Notice: Subject to any disclaimer, the term of this patent is extended or adjusted under 35 U.S.C. 154(b) by 299 days.

(21) Appl. No.: 17/359,518

(22) Filed: Jun. 26, 2021

(65) Prior Publication Data

US 2022/0412031 A1 Dec. 29, 2022

(51) Int. Cl.
*E02B 3/06* (2006.01)
*E02B 3/04* (2006.01)

(52) U.S. Cl.
CPC ..... *E02B 3/064* (2013.01); *E02B 3/041* (2015.09)

(58) Field of Classification Search
CPC combination set(s) only.
See application file for complete search history.

(56) References Cited

U.S. PATENT DOCUMENTS

| | | | | |
|---|---|---|---|---|
| 1,419,834 | A * | 6/1922 | Fellows | E04F 11/04 182/86 |
| 3,088,123 | A | 5/1963 | Loughridge | |
| 3,559,762 | A | 2/1971 | Thompson | |
| 3,592,468 | A | 7/1971 | Simendinger, Jr. | |
| 3,731,761 | A | 5/1973 | Glenn | |
| 3,813,703 | A | 6/1974 | Beaudin | |
| 3,949,693 | A | 4/1976 | Bauer et al. | |
| 4,053,028 | A | 10/1977 | Loix | |
| 4,079,815 | A | 3/1978 | Cormier | |
| 4,107,932 | A | 8/1978 | Centrell | |
| 4,271,542 | A | 6/1981 | Wood et al. | |
| 4,590,634 | A | 5/1986 | Williams | |
| 4,900,187 | A | 2/1990 | Uchida | |
| 4,907,674 | A | 3/1990 | Miller | |
| 4,910,814 | A | 3/1990 | Weiner | |
| 4,971,168 | A | 11/1990 | Stanescu | |
| 5,025,747 | A | 6/1991 | Grayson | |

(Continued)

FOREIGN PATENT DOCUMENTS

| | | |
|---|---|---|
| EP | 2312082 B1 | 8/2014 |
| WO | 2010068085 A1 | 6/2010 |
| WO | 2010084135 A1 | 7/2010 |

*Primary Examiner* — Kyle Armstrong
(74) *Attorney, Agent, or Firm* — Kim and Lahey Law Firm, LLC; Seann P. Lahey

(57) ABSTRACT

A movable platform adjacent to a stationary platform and operable between a raised position forming a part of a deck surface and a lowered position at least partially submerged in the body of water. A landing section and walkway section included in the movable platform. A lever arm carried by the landing section and extending underneath the walkway section, wherein the lever arm engages a bottom side of the walkway section when the movable platform is in the raised position, and the lever arm disengages from the walkway section when the movable platform is in the lowered position. A floatation unit disposed on the bottom side of the landing section. An air pump unit carried by the stationary platform, wherein the air pump unit channels air into and out of the floatation unit to change the buoyancy of the floatation unit to raise and lower the movable platform.

14 Claims, 7 Drawing Sheets

(56) References Cited

U.S. PATENT DOCUMENTS

| | | | | |
|---|---|---|---|---|
| 5,044,465 | A | 9/1991 | Rinke | |
| 5,056,167 | A | 10/1991 | Cholley | |
| 5,507,596 | A | 4/1996 | Bostelman | |
| 5,626,440 | A | 5/1997 | Greene et al. | |
| 5,791,292 | A | 8/1998 | Ricci | |
| 5,826,528 | A | 10/1998 | Jancsek | |
| 5,829,380 | A | 11/1998 | Smith | |
| 6,170,093 | B1 | 1/2001 | Kowalski | |
| 6,237,523 | B1 | 5/2001 | Day et al. | |
| 6,401,861 | B1 | 6/2002 | Marszalek | |
| 6,793,039 | B2 | 9/2004 | Schmid, Jr. | |
| 6,845,845 | B2 | 1/2005 | Schmid, Jr. | |
| 6,942,062 | B2 | 9/2005 | Schmid, Jr. | |
| 7,707,954 | B2 | 5/2010 | Thom et al. | |
| 9,205,896 | B2 | 12/2015 | Mueller | |
| 2003/0173152 | A1* | 9/2003 | Schmid, Jr. | E06C 1/387 182/86 |
| 2003/0178252 | A1* | 9/2003 | Schmid, Jr. | E04H 4/144 182/84 |
| 2020/0256125 | A1 | 8/2020 | Hoffmann | |
| 2021/0010271 | A1* | 1/2021 | Burger | B64D 11/00 |
| 2021/0147039 | A1* | 5/2021 | Johns | B63B 27/14 |

* cited by examiner

SUBMERGIBLE WATER ACTIVITY PLATFORM SYSTEM

BACKGROUND OF THE INVENTION

1) Field of the Invention

The present invention relates to a submergible water activity platform for use with a dock and the like to provide a platform for getting into and out of the surrounding water. More particularly, the present invention relates to a support system for a movable platform integrated into the dock so that the platform can move between a raised position level with and forming a rigid dock surface, and a lowered partially submerged position to provide access into an out of the water.

2) Description of Related Art

Swimming facilities, whether in pools, rivers, ponds, lakes, and oceans, often provide ladders for people to enter and exit deep water. These ladders may be attached to the end of docks, piers, or even free-floating platforms anchored in the middle of a lake. These ladders are usually slippery and require a person to exert substantial strength to pull their body out of the water and onto the ladder. Persons who have trouble using ladders, including the handicapped, elderly, and even small children are effectively banned from participating in recreational water activities associated with deep-water facilities. The ladder also fails to provide any underwater support on which a person can rest or participate in deep water recreational activities. People, as well as their pets, enjoy jumping and swimming from docks, but often are in danger of drowning when they cannot climb back on the dock or find a place to rest and are too tired to swim a long distance to shore.

Therefore, a need exists for a device that can facilitate the entry and exit of people and animals from a body of water to an above water structure by allowing the person and animals to swim directly onto a submerged platform and walk up out of the water by way of steps or a ramp. A need also exists to provide a device that gives underwater support to persons engaged in the recreational water activities in deep water on which the person can stand to participate in the water activities.

On many waterways, there are specific rules and regulations relating to the attachment of items that permanently extend off of a dock, some of which entirely prohibit underwater platforms that extend out from the dock. Therefore, there is a further need for a submergible activity platform system that is integrated into the dock so as not to extend away from the dock to pose an unnecessary hazard to watercraft, and for a submergible platform that can be withdrawn from the water when not in use.

A further challenge exists in providing such a submergible activity platform system that creates a rigid and stable deck surface in the raised arrangement with the rest of the surrounding deck surface of the dock. When the submergible platform and associated stairway are integrated into the dock to form a portion of a deck surface in the raised position, people will stand on and walk across the submergible activity platform system as part of the deck surface. Thus, a need arises to be able to adequately support the platform system to make it rigid with the rest of the deck surface.

Thus, there is a need for a submergible activity platform integrated into the dock that may be lowered to provide access into the water and raised to form a part of the dock above the water capable of providing a rigid deck surface with the rest of the surrounding deck surface of the dock.

Accordingly, it is an object of the present invention to provide a water recreation dock with a movable platform that moves between a lowered position that provides convenient access into and out of the water, and a raised position forming a part of a deck surface of the dock above the water.

It is an object of the present invention to provide a submergible activity platform that allows persons to swim directly onto and off of the platform for support in the water while engaged in recreational water activities.

It is an object of the present invention to provide a submergible activity platform integrated into the dock so that the platform does not extend out from the dock when submerged.

It is an object of the present invention to provide a support system underneath the submergible activity platform that firmly holds the steps and platform together in the raised position to provide a stable rigid upper deck surface of the dock on which people can stand and walk.

SUMMARY OF THE INVENTION

The above objectives are accomplished according to the present invention by providing a submergible water activity platform system comprising a stationary platform having a deck surface for accommodating a number of persons over a body of water; a movable platform adjacent to the stationary platform operable between a raised position forming a part of the deck surface and a lowered position at least partially submerged in the body of water; a landing section and a walkway section included in the movable platform; and, a lever arm carried on a bottom side of the landing section and extending underneath the walkway section, wherein the lever arm engages a bottom side of the walkway section and exerts an upward force against the walkway section when the movable platform is in the raised position, and the lever arm disengages from the walkway section when the movable platform is in the lowered position.

In a further advantageous embodiment, a drive assembly is operatively connected with the movable platform for raising and lowering the movable platform.

In a further advantageous embodiment, the drive assembly includes a floatation unit disposed on the bottom side of the landing section carried by the lever arm, and an air pump unit carried by the stationary platform, wherein the air pump unit channels air into and out of the floatation unit to change the buoyancy of the floatation unit to raise and lower the movable platform.

In a further advantageous embodiment, the walkway section includes a set of collapsible steps. The collapsible steps have a collapsed condition when the movable platform is in the raised position wherein each of the steps is folded into lateral alignment in a common horizontal plane with the stationary platform, and the collapsible steps having an expanded condition when the movable platform is in the lowered position wherein each of the steps is staggered in an inclined arrangement to provide steps leading from the stationary platform to the landing section.

In a further advantageous embodiment, a step frame is provided carrying the collapsible steps. The step frame has a first end pivotally connected to the stationary platform, and a second end pivotally connected to the landing section for moving with the landing section between the raised and lowered positions to collapse and expand the steps.

In a further advantageous embodiment, the step frame includes a first upper and lower linkage bar set pivotally connected to a first end surface of each the collapsible step, and a second upper and lower linkage bar set pivotally connected to a second end surface opposite the first end surface of each the collapsible step, wherein the first and second upper and lower linkage bar sets are each horizontally aligned and stacked in a vertical plane when the movable platform is in the raised position, and the first and second upper and lower linkage bar sets are each angled when the movable platform is in the lower position.

In a further advantageous embodiment, each of the lower linkage bars include a U-shaped mounting arm pivotally connected to the stationary platform at a first distal end portion, and each of the lower linkage bars is pivotally connected to the landing section at a second distal end portion.

In a further advantageous embodiment, a first distal end portion of each of the upper linkage bars is pivotally connected to the stationary platform, and a second distal end portion of each of the upper linkage bars is pivotally connected to the landing section.

In a further advantageous embodiment, the step frame includes at least one crossbar interconnecting the lower linkage bars adjacent a bottom side of the collapsible steps, and wherein the lever arm engages and exerts the upward force on the crossbar when the movable platform is in the raised position.

The above objectives are further accomplished according to the present invention by providing a submergible water activity platform system comprising a stationary platform having a deck surface for accommodating a number of persons over a body of water; a movable platform adjacent to the stationary platform operable between a raised position forming a part of the deck surface and a lowered position at least partially submerged in the body of water; a landing section and a walkway section included in the movable platform; a lever arm carried on a bottom side of the landing section and extending underneath the walkway section, wherein the lever arm engages a bottom side of the walkway section when the movable platform is in the raised position, and the lever arm disengages from the walkway section when the movable platform is in the lowered position; a floatation unit disposed on the bottom side of the landing section; an air pump unit carried by the stationary platform, wherein the air pump unit channels air into and out of the floatation unit to change the buoyancy of the floatation unit to raise and lower the movable platform; and, wherein the flotation unit biases the lever arm against the walkway section to exert an upward force against the bottom side of the walkway section when the movable platform is in the raised position.

In a further advantageous embodiment, the flotation unit is mounted to the lever arm on the bottom side of the landing section.

In a further advantageous embodiment, the walkway section includes a set of collapsible steps. The collapsible steps have a collapsed condition when the movable platform is in the raised position wherein each of the steps is folded into lateral alignment in a common horizontal plane with the stationary platform, and the collapsible steps having an expanded condition when the movable platform is in the lowered position wherein each of the steps is staggered in an inclined arrangement to provide steps leading from the stationary platform to the landing section.

In a further advantageous embodiment, a step frame is provided carrying the collapsible steps. The step frame has a first end pivotally connected to the stationary platform, and a second end pivotally connected to the landing section for moving with the landing section between the raised and lowered positions to collapse and expand the steps.

In a further advantageous embodiment, the step frame includes a first upper and lower linkage bar set pivotally connected to a first end surface of each the collapsible step, and a second upper and lower linkage bar set pivotally connected to a second end surface opposite the first end surface of each the collapsible step, wherein the first and second upper and lower linkage bar sets are each horizontally aligned and stacked in a vertical plane when the movable platform is in the raised position, and the first and second upper and lower linkage bar sets are each angled when the movable platform is in the lower position.

In a further advantageous embodiment, a pair of angle brackets are carried by the stationary platform, wherein one of the angle brackets extends adjacent a first side of the movable platform and the other of the angle brackets extends adjacent a second side of the movable platform opposite the first side, and wherein the angle brackets engage the upper linkage bars when the movable platform is in the raised position to stop upward movement of the movable platform.

In a further advantageous embodiment, a pair of landing stop members are carried on opposite sides of the landing section, wherein the landing stop members engage the angle brackets when the movable platform is in the raised position to stop upward movement of the movable platform.

In a further advantageous embodiment, a movable platform deck surface is carried on the walkway section and the landing section is level with the deck surface of the stationary platform when the upper linkage bars and the landing stop members engage the angle brackets in the raised position.

The above objectives are further accomplished according to the present invention by providing a submergible water activity platform system comprising a stationary platform having a deck surface for accommodating a number of persons over a body of water; a movable platform adjacent to the stationary platform operable between a raised position forming a part of the deck surface and a lowered position at least partially submerged in the body of water; a landing section and a walkway section included in the movable platform; a lock assembly carried by the landing section engaging the stationary platform to hold the movable platform in the raised position and disengaging from the stationary platform to allow the movable platform to move to the lowered position; a floatation unit disposed on the bottom side of the landing section; and, an air pump unit carried by the stationary platform, wherein the air pump unit channels air into and out of the floatation unit to change the buoyancy of the floatation unit to raise and lower the movable platform.

In a further advantageous embodiment, a lever arm is carried on a bottom side of the landing section and extending underneath the walkway section, wherein the lever arm engages a bottom side of the walkway section when the movable platform is in the raised position, and the lever arm disengages from the walkway section when the movable platform is in the lowered position; and, wherein the flotation unit biases the lever arm against the walkway section to exert an upward force against the bottom side of the walkway section when the movable platform is in the raised position.

In a further advantageous embodiment, the lock assembly includes a rotatable hub operatively connected to at least one locking bar, wherein rotation of the hub causes the at least one locking bar to move between an engaged position with the stationary platform and a disengaged position from the stationary platform to allow movement of the movable platform.

BRIEF DESCRIPTION OF THE DRAWINGS

The system designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
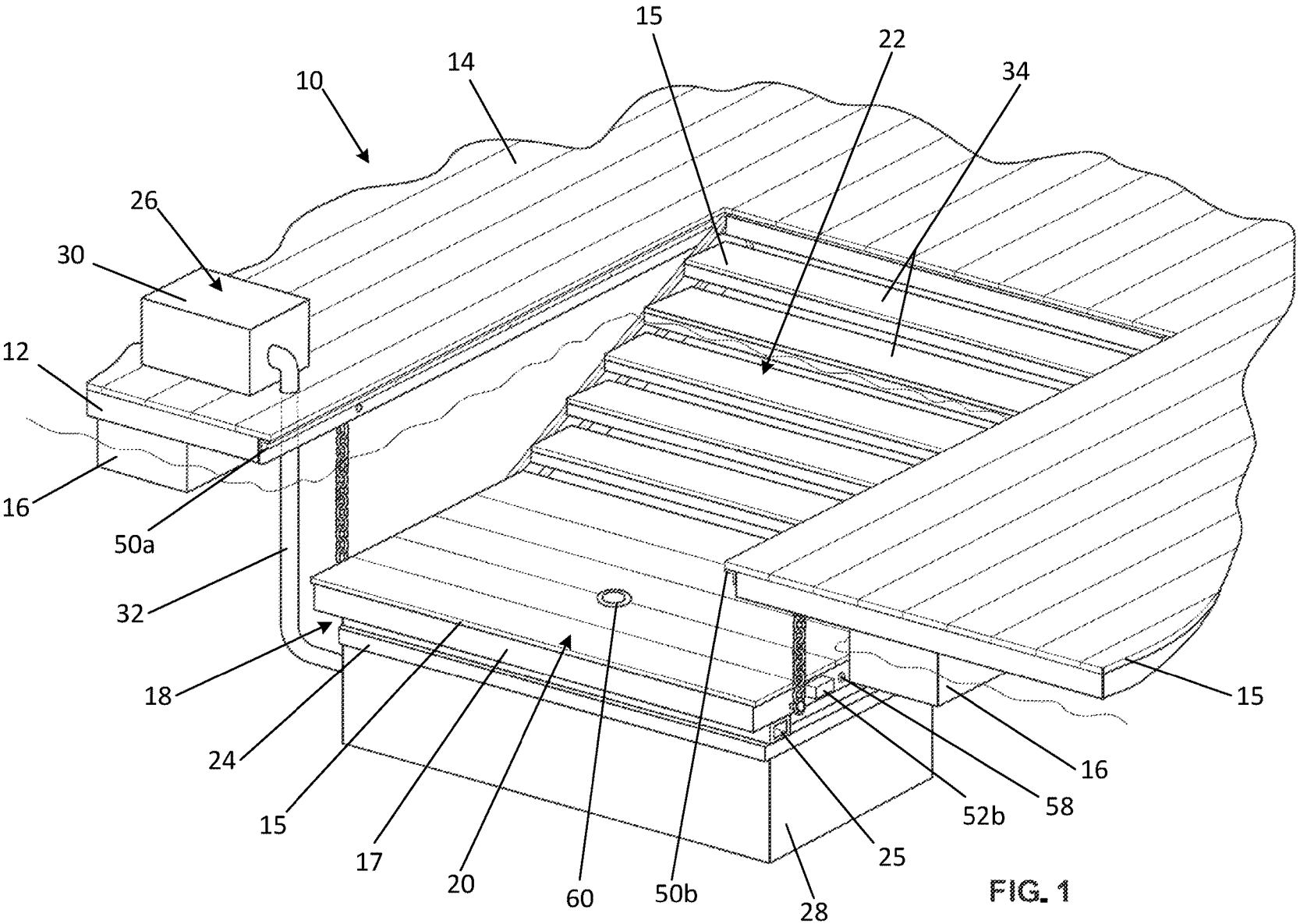
FIG. 1 shows a perspective view of a submergible water activity platform system with a movable platform in a lowered position according to the present invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Figure 2:
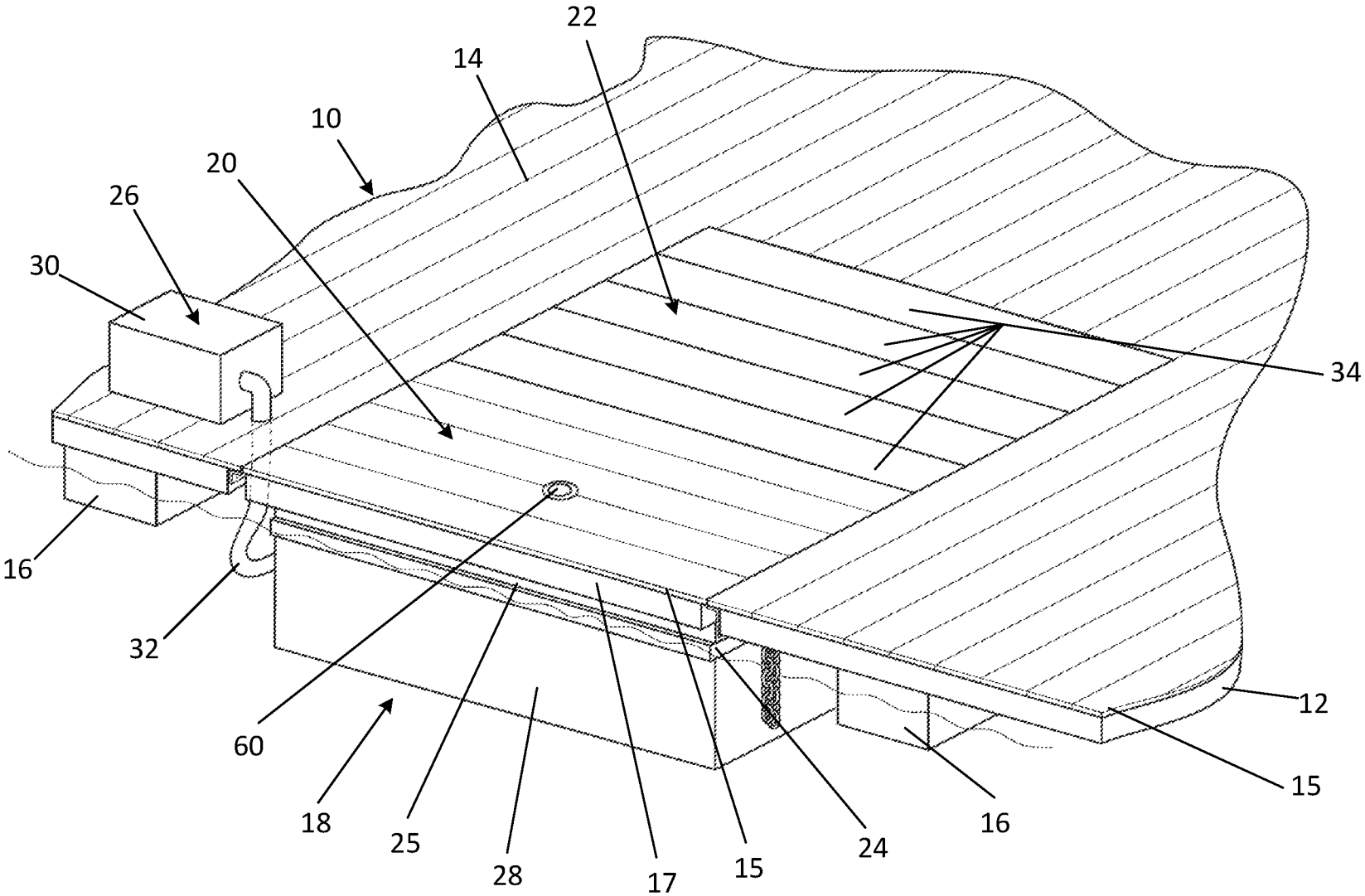
FIG. 2 shows a perspective view of a submergible water activity platform system with the movable platform in a raised position according to the present invention.

Referring to FIGS. 1 and 2, a water recreation dock is shown extending at least partially over a body of water for providing access into and out of the water. The dock comprises a main deck platform, designated generally as 10, carried by an upper dock frame 12 which is generally supported above the water. The main deck platform is adapted for accommodating several persons engaged in recreational activities.

The main deck platform is divided into two parts, which together form main deck platform 10. A stationary platform 14 forms the first part of the main deck platform. As shown in the illustrated embodiment, stationary platform 14 is supported above the water on upper dock frame 12 by floating members 16. The floating members allow the stationary platform to adjust to changes in water level to ensure stationary platform 14 does not become too far removed from the surface of the water. However, various alternative means for supporting a platform on a body of water are commonly known to those skilled in the art and considered within the spirit and scope of this invention.

A movable platform, designated generally as 18, forms the second part of the main deck platform. Movable platform 18 is integrated into stationary platform 14 so that the movable platform does not extend out from the dock and create an obstruction to boats and other watercraft operating next to the dock. Movable platform 18 is operable between a raised position, shown in FIG. 2, and a lowered position, shown in FIG. 1, to provide a submergible water activity platform. The associated structure defining stationary platform 14 that incorporates movable platform 18 can be any above water structure such as a dock, pier, free-floating platform, deck surrounding a pool, or boat deck or other platform where ingress and egress from a body of water is desired. According to the illustration of a preferred embodiment in FIG. 1, the associated structure of stationary platform 14 is characterized by a standard commercial dock, which extends from the shore of a body of water into deeper water for swimming and other recreational water activities.

In the illustrated embodiment, movable platform 18 includes a landing section, designated generally as 20, and a walkway section, designated generally as 22, for providing access into and out of the water from stationary platform 14. Advantageously, as shown in FIG. 2, movable platform 18 can be raised to lie generally in a common horizontal plane with stationary platform 14 so that the landing section 20 and walkway section 22 are positioned above the water with the stationary platform 14 to provide a main deck surface that is entirely removed from the water. In the raised position, stationary platform 14 and movable platform 18 form a uniformly level main deck surface. The raised position also provides the benefits of easy cleaning to remove algae, barnacles and other debris that collect on the movable platform 18 when in the lowered position. In the lowered position shown in FIG. 1, movable platform 18 is at least partially submerged in the water below stationary platform 14 so that landing section 20 is submerged and walkway section 22 is partially submerged as extending from stationary platform 14 to landing section 20 to provide access into and out of the water. In the illustrated embodiment, landing section 20 creates a water activity area free of walkway 22 for supporting persons engaged in water activities. Thus, when the landing section is submerged, people can stand, sit, or swim off of or directly onto the submerged water activity area of the landing section for support in the water. This effectively creates a shallow water area for people to enjoy water recreation activities around deep-water facilities without the problems associated with typical ladders that are used to enter and exit from the water.

In the illustrated embodiment, stationary platform 14 and movable platform 18 have a deck surface material 15 carried by an underlying frame structure 12 and 17, respectively. Preferably, deck surface material 15 is composed of a series of elongated planks made from treated lumber, composite materials, or other known components resistant to the corrosive effective of water and other elements commonly used to build docks. The upper dock frame 12 and frame structure 17 for movable platform 18 may be aluminum, treated steal or other elements commonly used to build docks.

Figure 3:
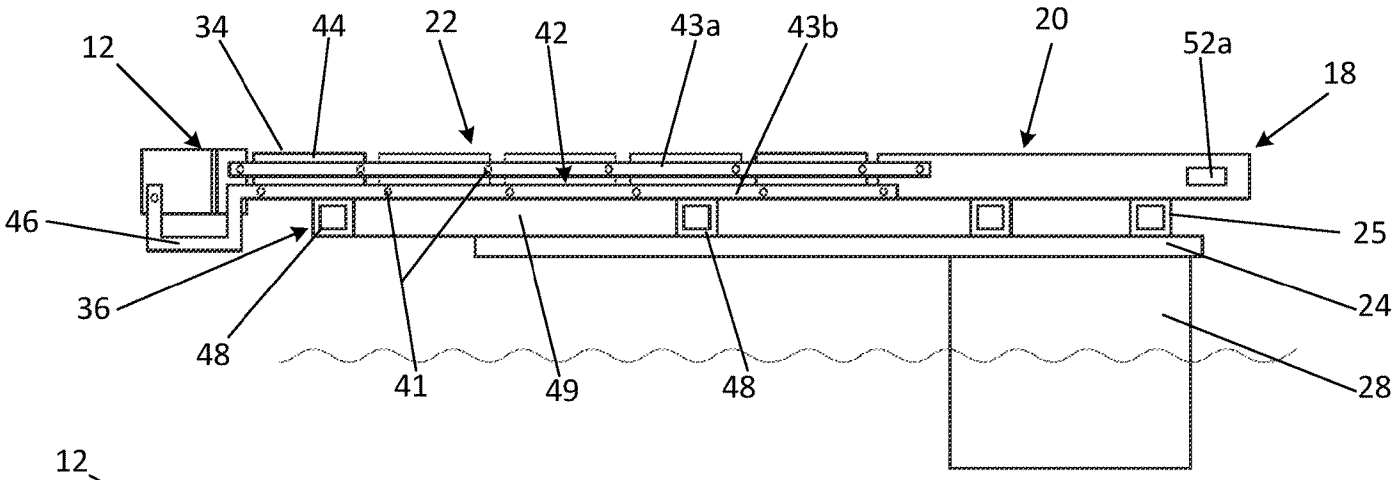
FIG. 3 shows a side elevation view of the movable platform in a raised position according to the present invention.
Figure 4:
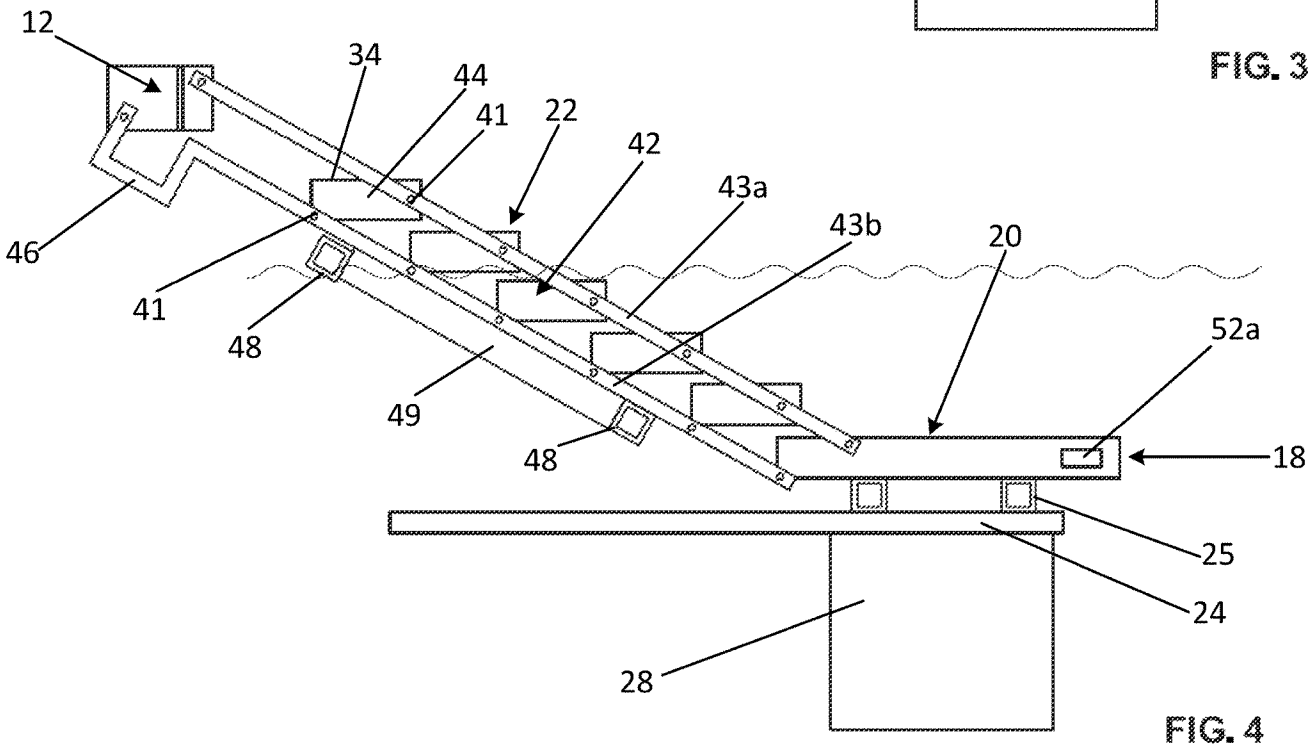
FIG. 4 shows a side elevation view of the movable platform in a lowered position according to the present invention.

Referring to FIGS. 3, 4, 8 and 9, to provide a rigid support for the walkway section 22 of movable platform 18 when in the raised position, a lever arm 24 is carried on a bottom side of landing section 20 and extends underneath the walkway section 22. The lever arm 24 engages a bottom side of walkway section 22 and exerts an upward force against the walkway section when movable platform 18 is in the raised position, as best shown in FIG. 3. Lever arm 24 disengages from walkway section 22 when movable platform 18 is in the lowered position, as best shown in FIG. 4, to allow for deployment of the walkway section.

Referring to FIGS. 1. 2 and 8, a drive assembly, designated generally as 26, is operatively connected with movable platform 18 for raising and lowering the movable platform. The drive assembly can be formed using any number of commonly known mechanisms to those persons skilled in the art, such as hydraulic, pneumatic and electromechanical operators adapted for raising and lowering the movable platform as described herein. Preferably, the vertical displacement mechanism allows the landing section 20 to move at least two feet downward from the raised position to the lowered position. However, the invention is not limited to this distance and the drive assembly can be constructed and arranged to allow the movable platform to travel less than or considerably beyond two feet.

Figure 9:
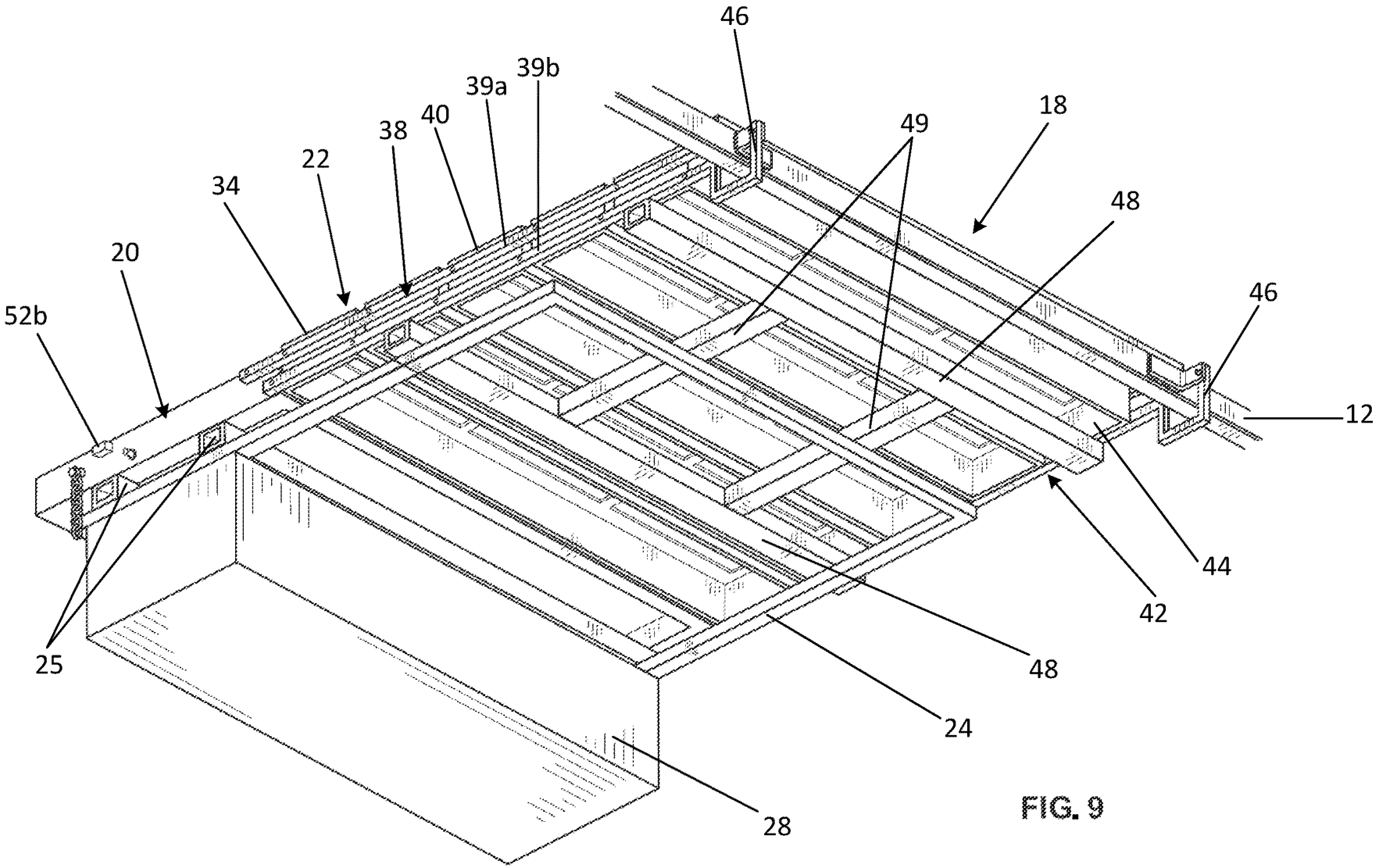
FIG. 9 shows a bottom perspective view of the movable platform in a raised position according to the present invention; and, FIG. 10 shows a perspective cut-away view of an upper and lower linkage bar set with the upper linkage bar engaging the angle bracket according to the present invention.
Figure 10:
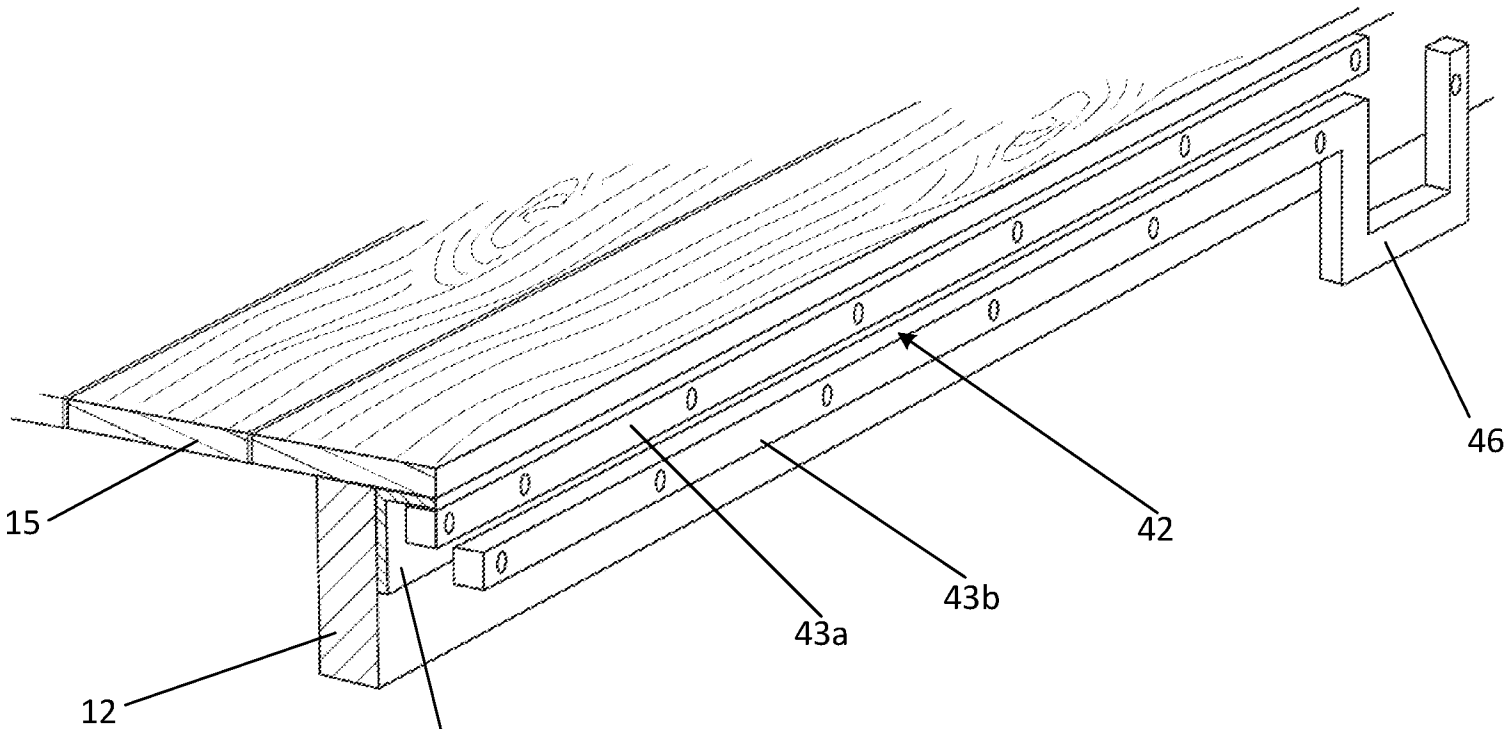

In the illustrate embodiment, drive assembly 26 includes a floatation unit 28 disposed on a bottom side of the landing section 20 carried by the lever arm 24. In the illustrated embodiment, lever arm 24 is carried by frame members 25 disposed on a bottom side of landing section 20. Frame members 25 space lever arm 24 below landing section 20 for engagement with a series of crossbars 48, 49 disposed on a bottom side of walkway section 22 when the movable platform is in the raised position, as best shown in FIGS. 3 and 9. Further, drive assembly 26 includes an air pump unit 30 carried by the stationary platform 14. Air pump unit 30 includes an air hose 32 extending between air pump 30 and floatation unit 28. Air pump unit 30 channels air into and out of floatation unit 28 via air hose 32 to change the buoyancy of the floatation unit 28 to raise and lower movable platform 18. The location of floatation unit 28 is important to allow for full deployment of movable platform 18. For an eight-foot length movable platform, the floatation unit 28 must have a center of gravity no more than two feet from the end of the landing section 20. Preferably, the lift from floatation unit 28 (in the raised position) is approximately 700 pounds. The assembly weight of movable platform 18 is roughly 400 pounds, of which roughly 200 pounds is supported by the attachment to the stationary platform 14. Thus, approximately 500 pounds of force is acting to support any additional load on movable platform 18 when in the raise position. This upward force is applied through lever arm 24 to the underside of walkway section 22 to provide a rigid and stable surface in the raised position. Further, additional load is partially supported by the lock assembly 54 connecting the movable platform 18 to the stationary platform 14 as detailed herein below. The net result is that the flotation unit upward force in the illustrated embodiment is quite sufficient to firmly hold the movable platform in place in the raised position.

Referring to FIGS. 1-4, walkway section 22 comprises a set of collapsible steps 34, which can function as a set of steps leading from stationary platform 14 to landing section 20, or as a ramp when the movable platform is in the lowered position. In the illustrated embodiments, the collapsible steps have a collapsed condition when the movable platform is in the raised position, best shown in FIGS. 2 and 3, wherein each of steps 34 is folded into lateral alignment in a common horizontal plane and aligned in a level uniform arrangement with stationary platform 14. The collapsible steps 34 also then have an expanded deployed condition when the movable platform 18 is in the lowered position, best shown in FIGS. 1 and 4, wherein each of steps 34 is opened and staggered in an inclined arrangement to provide a set of steps leading from stationary platform 14 to landing section 20.

Figure 8:
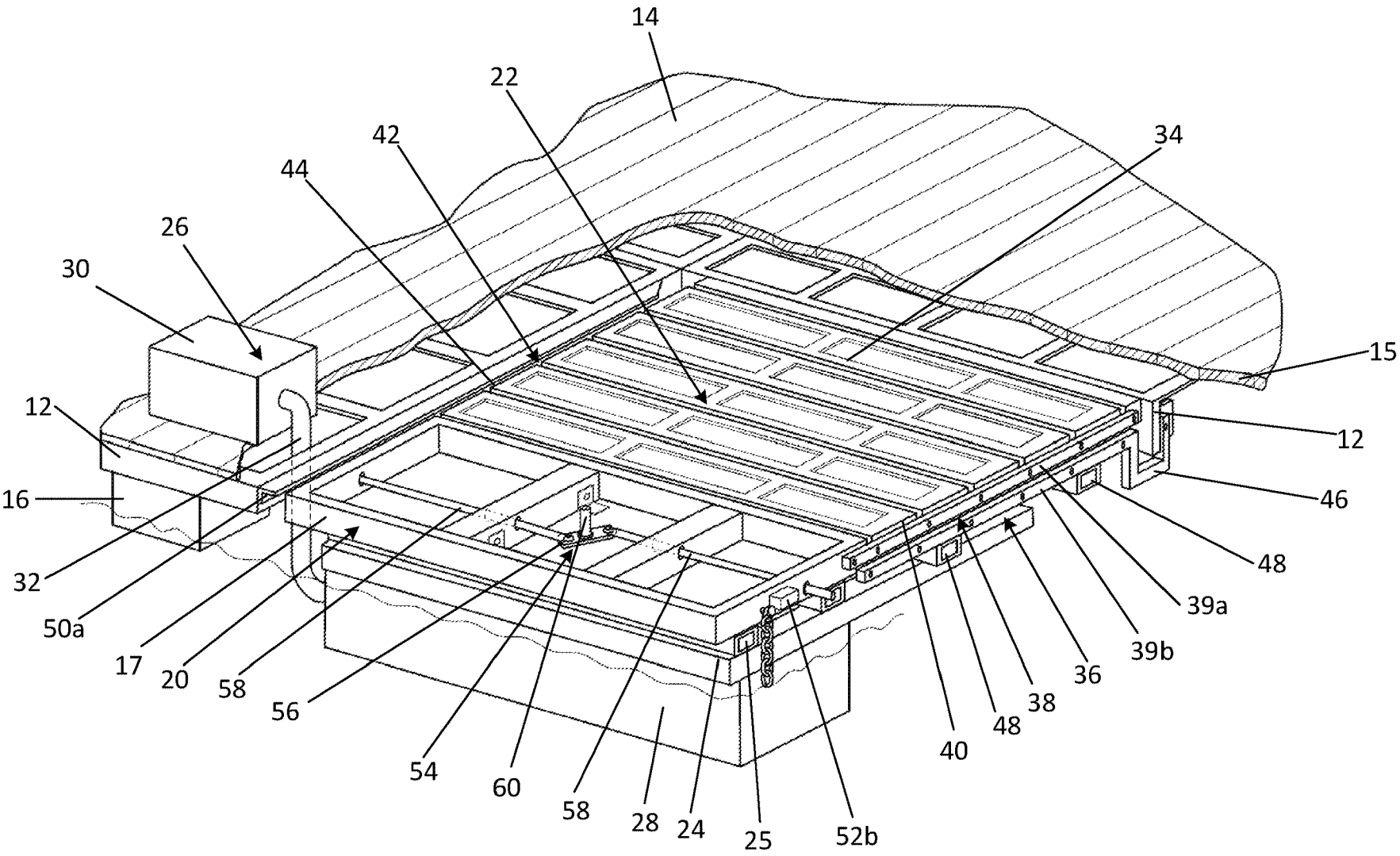
FIG. 8 shows a perspective view of the submergible water activity platform system with the movable platform in a raised position and the deck surface partially removed according to the present invention.

Referring to FIGS. 3, 4 and 8, a step frame, designated generally as 36, is provided carrying each of the collapsible steps 34. The step frame 36 has a first end pivotally connected to the dock frame 12 of stationary platform 14, and a second end pivotally connected to the landing section 20 for moving with the landing section between the raised and lowered positions to collapse and expand the steps 34.

By pivotally attaching step frame 36 at both ends, the step frame moves with landing section 20 between the raised and lowered positions to collapse and expand the steps 34.

Referring to FIGS. 3, 4, 8 and 9, in the illustrated embodiment, step frame 36 includes a first upper and lower linkage bar set 38 having an upper linkage bar 39*a* and a lower linkage bar 39*b*. The upper linkage bar 39*a* and lower linkage bar 39*b* are pivotally connected to a first end surface 40 of each of the collapsible step 34. Step frame 36 further includes a second upper and lower linkage bar set 42 having an upper linkage bar 43*a* and a lower linkage bar 43*b*. The upper linkage bar 43*a* and lower linkage bar 43*b* are pivotally connected to a second end surface 44 opposite the first end surface 40 of each of the collapsible steps. As best shown in FIGS. 3 and 4, a bolt 41 or other like fastener member pivotally interconnects the upper and lower linkage bars to the end surfaces 40, 44 of the collapsible steps 34. To facilitate movement of the collapsible steps to the expanded position when the movable platform is lowered, bolts 41 attaching the upper linkage bars 39*a*, 43*a* are located in a forward portion of the end surface 40, 44, while the bolts 41 attaching the lower linkage bars 39*b*, 43*b* are located in a rearward portion of the end surface 40, 44. As best shown in FIGS. 3 and 4, the first and second upper and lower linkage bar sets 38, 42 are each horizontally aligned and stacked in a vertical plane when the movable platform is in the raised position, and the first and second upper and lower linkage bar sets 38, 42 are each angled when the movable platform is in the lower position.

Each of the lower linkage bars 39*b*, 43*b* include a U-shaped mounting arm 46 pivotally connected to dock frame 12 of the stationary platform 14 at a first distal end portion. Each of the lower linkage bars 39*b*, 43*b* is also pivotally connected to the landing section 20 at a second distal end portion. Likewise, a first distal end portion of each of the upper linkage bars 39*a*, 43*a* is pivotally connected to dock frame 12 of the stationary platform 14, and a second distal end portion of each of the upper linkage bars 39*a*, 43*a* is pivotally connected to the landing section 20. As a result, the movable platform 18 is operable between the raised and lowered positions.

Referring to FIG. 9, step frame 36 includes at least one crossbar 48 interconnecting the lower linkage bars 39*b*, 43*b* adjacent a bottom side of the collapsible steps 34. In the illustrated embodiment, a plurality of crossbars 48 are provided that interconnected lower linkage bars 39*b*, 43*b* underneath the collapsible steps 34. To further reinforce the structure to resist flexing and twisting, a plurality of crossbar frame members 49 are provided that extend between and interconnect crossbars 48 to form and generally H-shaped ladder structure. Accordingly, lever arm 24 engages and exerts the upward force on the crossbars and frame members 48, 49 when the movable platform is in the raised position to firmly hold the collapsible steps 34 in a rigid and staple collapsed condition.

Figure 5:
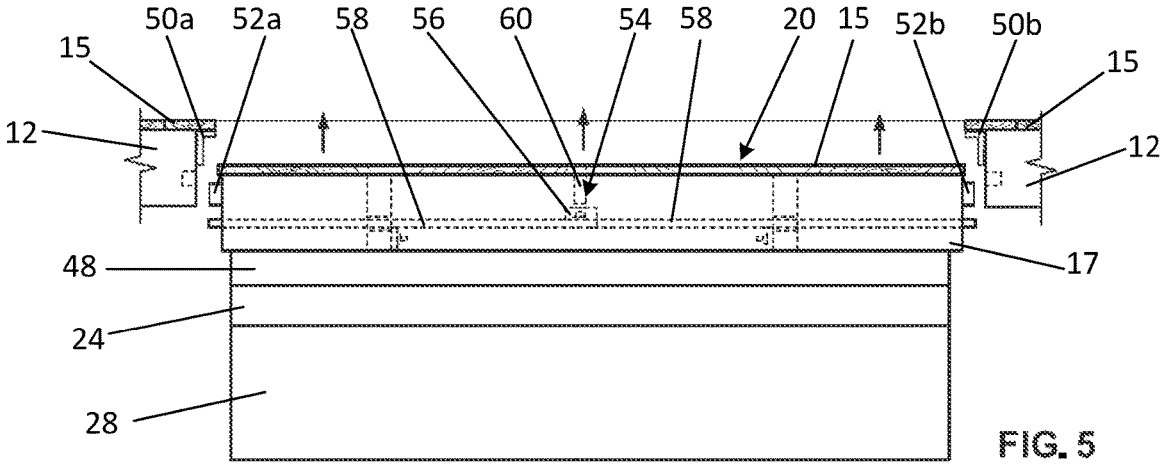
FIG. 5 shows a front elevation view of the movable platform in a partially raised position according to the present invention.
Figure 6:
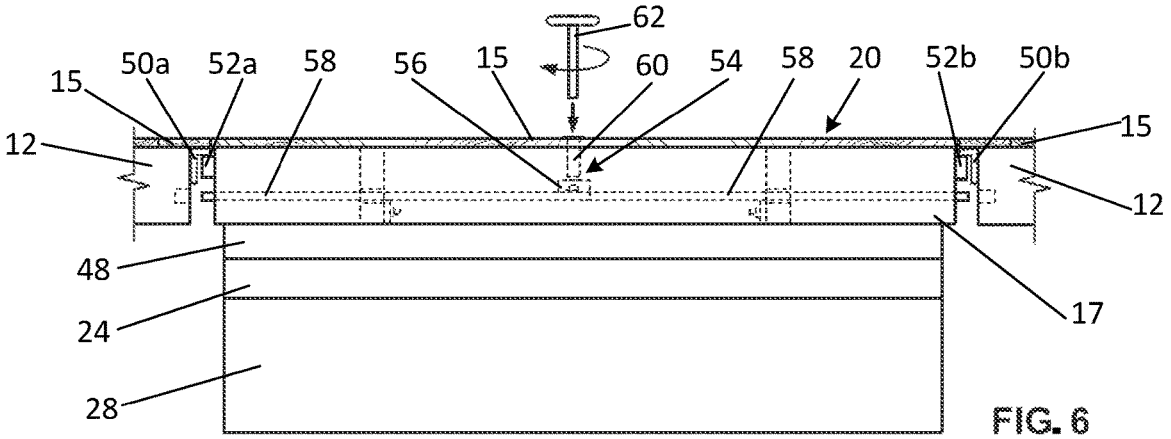
FIG. 6 shows a front elevation view of the movable platform in a fully raised position with the locking assembly in a disengaged position according to the present invention.
Figure 7:
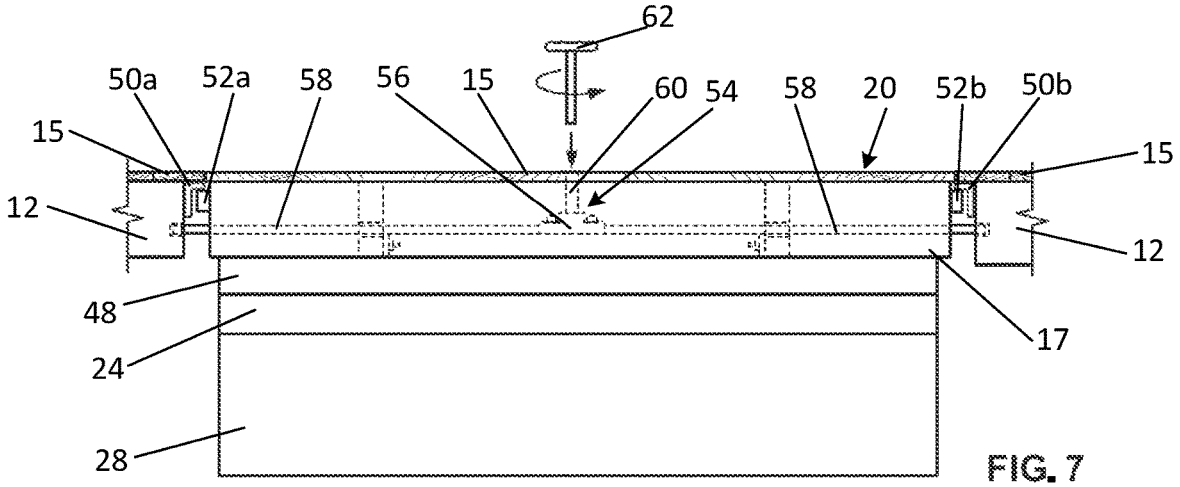
FIG. 7 shows a front elevation view of the movable platform in a fully raised position with the locking assembly in an engaged position according to the present invention.

Referring to FIGS. 1, 5-7 and 10, in the illustrated embodiment, a pair of angle brackets 50*a*, 50*b* are carried by the dock frame 12 of the stationary platform 14. One of the angle brackets 50*a* extends adjacent a first side of the movable platform and the other of the angle brackets 50*b* extends adjacent a second side of the movable platform opposite the first side. The angle brackets 50*a*, 50*b* engage the upper linkage bars 39*a*, 43*a* when the movable platform 18 is in the raised position to stop upward movement of the movable platform. Additionally, a pair of landing stop members 52*a*, 52*b* are carried on opposite sides of the landing section 20. As best shown in FIGS. 5-7, the landing stop members 52*a*, 52*b* engage the angle brackets 50*a*, 50*b*, respectively, when the movable platform is in the raised position to stop upward movement of the movable platform 18. The deck surface 15 of movable platform 18 is carried on the walkway section 22 and the landing section 20. The deck surface 15 of the stationary platform 14 is level with the deck surface 15 of the walkway section 22 and the landing section 20 when the upper linkage bars 39*a*, 43*a* and the landing stop members 52*a*, 52*b* engage the angle brackets 50*a*, 50*b* in the raised position of movable platform 18.

Referring to FIGS. 5-7 and 8, in the preferred embodiment, a lock assembly, designated generally as 54, is operatively associated with stationary platform 14 and movable platform 18 for locking movable platform 18 to stationary platform 14 in the raised position. The lock assembly provides an added measure of safety to prevent the movable platform 18 from accidentally lowering with people standing on the movable platform. In the illustrated embodiment, lock assembly 54 is carried by the landing section 20. The lock assembly 54 engages the dock frame 12 or associated static members of stationary platform 14 to hold the movable platform 18 in the raised position, and disengages from the dock frame 12 or associated static members of stationary platform 14 to allow the movable platform 18 to move to the lowered position. The lock assembly 54 includes a rotatable hub 56 operatively connected to a pair of locking bars 58. A shaft 60 extends from the rotatable hub 56 through deck surface 15 on landing section 20, as best shown in FIG. 1. In a preferred embodiment, shaft 60 is operatively connected to rotatable hub 56 such that rotation of shaft 60 by a tool 62 causes a rotation of hub 56. Rotation of the hub 56 causes the locking bars 58 to move between an engaged position with the dock frame 12 or associated static members of stationary platform 14 and a disengaged position to allow movement of the movable platform 18.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A submergible water activity platform system comprising:

a stationary platform having a deck surface for accommodating a number of persons over a body of water;

a movable platform adjacent to said stationary platform operable between a raised position forming a part of said deck surface and a lowered position at least partially submerged in said body of water;

a landing section and a walkway section included in said movable platform;

a lever arm carried on a bottom side of said landing section and extending underneath said walkway section, wherein said lever arm engages a bottom side of said walkway section and exerts an upward force against said walkway section when said movable platform is in said raised position, and said lever arm disengages from said walkway section when said movable platform is in said lowered position;

said walkway section including a set of collapsible steps; said collapsible steps having a collapsed condition when said movable platform is in said raised position wherein each of said steps is folded into lateral alignment in a common horizontal plane with said stationary platform, and said collapsible steps having an expanded condition when said movable platform is in said lowered position wherein each of said steps is staggered in an inclined arrangement to provide steps leading from said stationary platform to said landing section;

a step frame carrying said collapsible steps; said step frame having a first end pivotally connected to said stationary platform, and a second end pivotally connected to said landing section for moving with said landing section between said raised and lowered positions to collapse and expand said steps;

said step frame includes a first upper and lower linkage bar set pivotally connected to a first end surface of each said collapsible step, and a second upper and lower linkage bar set pivotally connected to a second end surface opposite said first end surface of each said collapsible step, wherein said first and second upper and lower linkage bar sets are each horizontally aligned and stacked in a vertical plane when said movable platform is in said raised position, and said first and second upper and lower linkage bar sets are each angled when said movable platform is in said lower position; and, wherein each of said lower linkage bars include a U-shaped mounting arm pivotally connected to said stationary platform at a first distal end portion, and each of said lower linkage bars is pivotally connected to said landing section at a second distal end portion.

2. The platform system of claim 1 including a drive assembly operatively connected with said movable platform for raising and lowering said movable platform.

3. The platform system of claim 2 wherein said drive assembly includes a floatation unit disposed on said bottom side of said landing section carried by said lever arm, and an air pump unit carried by said stationary platform, wherein said air pump unit channels air into and out of said floatation unit to change the buoyancy of said floatation unit to raise and lower said movable platform.

4. The platform system of claim 1 wherein a first distal end portion of each of said upper linkage bars is pivotally connected to said stationary platform, and a second distal end portion of each of said upper linkage bars is pivotally connected to said landing section.

5. The platform system of claim 1 wherein said step frame includes at least one crossbar interconnecting said lower linkage bars adjacent a bottom side of said collapsible steps, and wherein said lever arm engages and exerts said upward force on said crossbar when said movable platform is in said raised position.

6. A submergible water activity platform system comprising:

a stationary platform having a deck surface for accommodating a number of persons over a body of water;

a movable platform adjacent to said stationary platform operable between a raised position forming a part of said deck surface and a lowered position at least partially submerged in said body of water;

a landing section and a walkway section included in said movable platform;

a movable platform deck surface carried on said walkway section and said landing section being coplanar with said deck surface of said stationary platform in said raised position;

a lock assembly carried by said landing section engaging said stationary platform to hold said movable platform in said raised position and disengaging from said stationary platform to allow said movable platform to move to said lowered position;

said lock assembly including a rotatable hub operatively connected to at least one locking bar extending parallel with said movable platform deck surface;

a complementary locking bar recess defined in said stationary platform is collinear with said at least one locking bar when said movable platform is in said raised position; and, wherein rotation of said hub causes said at least one locking bar to move parallel to said movable platform deck surface and be received in said complementary locking bar recess to lock said movable platform in said raised position.

7. The platform system of claim 6 wherein said walkway section includes a set of collapsible steps; said collapsible steps having a collapsed condition when said movable platform is in said raised position wherein each of said steps is folded into lateral alignment in a common horizontal plane with said stationary platform, and said collapsible steps having an expanded condition when said movable platform is in said lowered position wherein each of said steps is staggered in an inclined arrangement to provide steps leading from said stationary platform to said landing section.

8. The platform system of claim 7 including a step frame carrying said collapsible steps; said step frame having a first end pivotally connected to said stationary platform, and a second end pivotally connected to said landing section for moving with said landing section between said raised and lowered positions to collapse and expand said steps.

9. The platform system of claim 8 wherein said step frame includes a first upper and lower linkage bar set pivotally connected to a first end surface of each said collapsible step, and a second upper and lower linkage bar set pivotally connected to a second end surface opposite said first end surface of each said collapsible step, wherein said first and second upper and lower linkage bar sets are each horizontally aligned and stacked in a vertical plane when said movable platform is in said raised position, and said first and second upper and lower linkage bar sets are each angled when said movable platform is in said lower position.

10. The platform system of claim 9 including a pair of angle brackets carried by said stationary platform, wherein one of said angle brackets extends adjacent a first side of said movable platform and the other of said angle brackets extends adjacent a second side of said movable platform opposite said first side, and wherein said angle brackets engage said upper linkage bars when said movable platform is in said raised position to stop upward movement of said movable platform.

11. The platform system of claim 10 including a pair of landing stop members carried on opposite sides of said landing section, wherein said landing stop members engage said angle brackets when said movable platform is in said raised position to stop upward movement of said movable platform.

12. The platform system of claim 11 wherein said upper linkage bars and said landing stop members engage said angle brackets when said movably platform in said raised position.

13. A submergible water activity platform system comprising:

a stationary platform having a deck surface for accommodating a number of persons over a body of water;

a movable platform adjacent to said stationary platform operable between a raised position forming a part of said deck surface and a lowered position at least partially submerged in said body of water;

a landing section and a walkway section included in said movable platform;

a lock assembly carried by said landing section engaging said stationary platform to hold said movable platform in said raised position and disengaging from said stationary platform to allow said movable platform to move to said lowered position;

a floatation unit disposed on said bottom side of said landing section;

an air pump unit carried by said stationary platform, wherein said air pump unit channels air into and out of said floatation unit to change the buoyancy of said floatation unit to raise and lower said movable platform; and, said lock assembly including a rotatable hub operatively connected to at least one locking bar, wherein rotation of said hub causes said at least one locking bar to move between an engaged position with said stationary platform and a disengaged position from said stationary platform to allow movement of said movable platform.

14. The platform system of claim 13 including a lever arm carried on a bottom side of said landing section and extending underneath said walkway section, wherein said lever arm engages a bottom side of said walkway section when said movable platform is in said raised position, and said lever arm disengages from said walkway section when said movable platform is in said lowered position; and, wherein said flotation unit biases said lever arm against said walkway section to exert an upward force against said bottom side of said walkway section when said movable platform is in said raised position.

* * * * *